United States Patent [19]

Griffith

[11] Patent Number: 5,012,844

[45] Date of Patent: May 7, 1991

[54] WEFT YARN THREADING DEVICE FOR A JET LOOM

[75] Inventor: John D. Griffith, Cleadon, Great Britain

[73] Assignee: Sulzer Brothers Limited, Winterthur, Switzerland

[21] Appl. No.: 416,935

[22] Filed: Oct. 4, 1989

[30] Foreign Application Priority Data

Oct. 19, 1988 [CH] Switzerland ..... 03899/88

[51] Int. Cl.[5] ..... D03D 47/34

[52] U.S. Cl. ..... 139/452; 139/116.2; 139/435.1; 139/453

[58] Field of Search ..... 139/452, 435.1, 116.2, 139/450, 453; 242/47.01

[56] References Cited

U.S. PATENT DOCUMENTS

| | | | |
|---|---|---|---|
| 4,538,650 | 9/1985 | Kodama et al. | 139/452 |
| 4,658,866 | 4/1987 | Takegawa | 139/450 |
| 4,744,393 | 5/1988 | Takegawa | 139/452 X |
| 4,830,063 | 5/1989 | Takegawa | 139/452 X |
| 4,877,064 | 10/1989 | Pezzoli | 139/452 X |

FOREIGN PATENT DOCUMENTS

| | | |
|---|---|---|
| 0128121 | 12/1984 | European Pat. Off. . |
| 0171057 | 2/1986 | European Pat. Off. . |
| 0269140 | 6/1988 | European Pat. Off. . |
| 3619105 | 12/1987 | Fed. Rep. of Germany . |
| WO88/01659 | 8/1987 | PCT Int'l Appl. . |

*Primary Examiner*—Andrew M. Falik

*Attorney, Agent, or Firm*—Kenyon & Kenyon

[57] ABSTRACT

A loom is provided with a closed path for the weft yarn from a yarn package to a picking nozzle. A first yarn guiding passage extends from a yarn clamp to a weft yarn storage device while a second yarn guiding passage extends from the storage device to the picking nozzle. Sensors are disposed along the path of the yarn in order to sense the presence or absence of a thread for searching/rethreading purposes. The second yarn guiding passage is articulated to the storage device and the picking nozzle in order to follow movements of the picking nozzles relative to a reed.

27 Claims, 7 Drawing Sheets

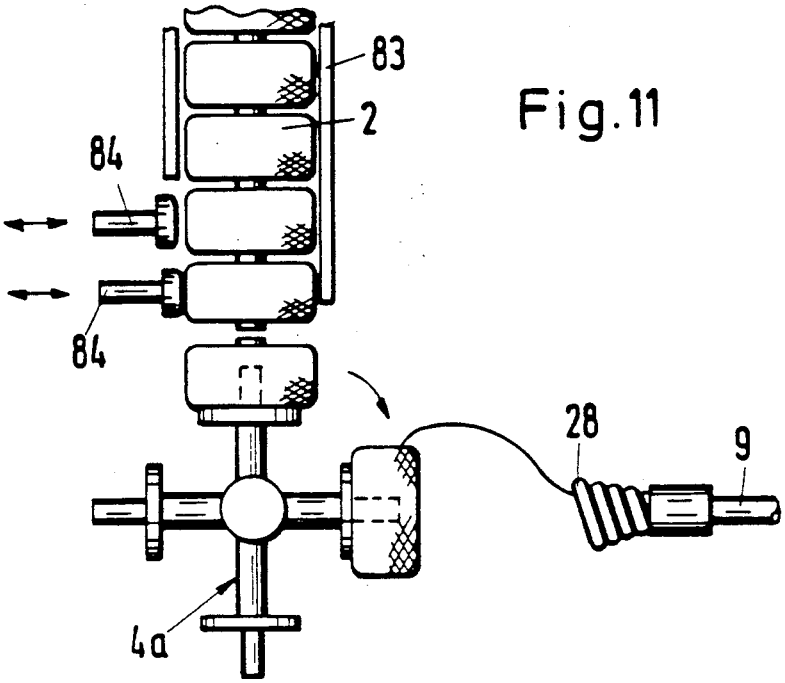
Fig.11
Fig.12
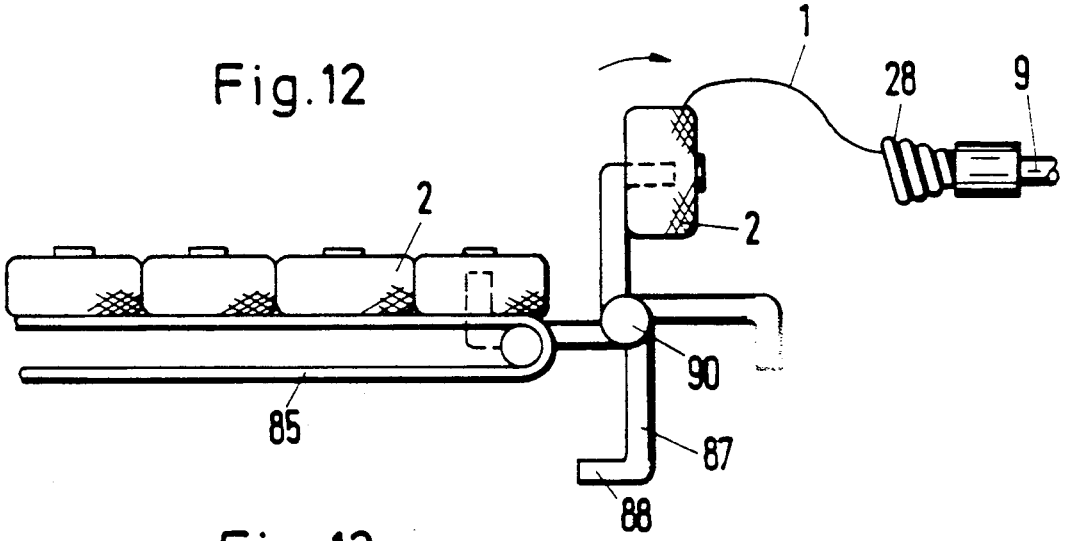
Fig.13
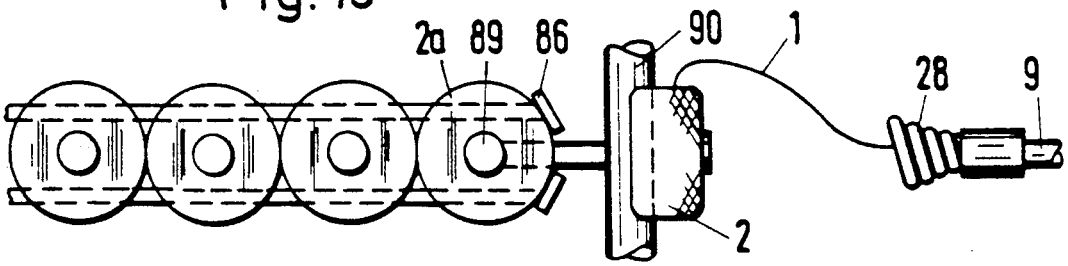

WEFT YARN THREADING DEVICE FOR A JET LOOM

This invention to a device for threading a yarn in a loom. More particularly, this invention relates to a device for threading a weft yarn into a loom.

As is known, in textile machines, particularly in air jet looms, yarn threading, particularly of the weft yarn, is a problem both in bobbin changing and, for example, in the event of a yarn breakage.

DE-OS 3,619105 discloses, for example, a method of changing work yarns in textile machines, such as circular knitting machines, wherein yarn changing is carried out without interrupting the operation of the machine by knotting or splicing a second work yarn to a first work yarn. Also WO88/01659 describes a method of connecting the start of a reserve bobbin to the terminating or, in the event of a yarn defect, severed end of a yarn running off a cheese or the like. In this case, the yarn start of the prepared bobbin is so advanced that, in the event of a yarn-exhausted report or of a yarn fault, the prepared yarn is joined to the terminating yarn by knotting or splicing. However, both methods suffer in the first place from the disadvantage that, for example, knots remain in the fabric so that yarn parts must be subsequently cut away in the region affected. Since the place of a yarn break for splicing cannot be planned or determined beforehand, a splicing chamber is not necessarily disposed at the appropriate place.

U.S. Pat. No. and EPA 0,171, 057 describe a method of and apparatus for extracting and replacing a yarn which breaks in a yarn-threading facility. For this purpose, at least two packages are provided, the yarn ends being retained by grippers. In the event of a yarn breakage, a yarn-guiding passage is moved to one yarn end and automatically sucks the yarn end into the passage and conveys the yarn end to a yarn storage device. The yarn end which projects out of the passage is then sucked in by another suction nozzle, whereafter the yarn storage device is rotated and a sufficient number of turns are wound thereon. Thereafter, the new yarn is conveyed to a picking nozzle by appropriate suction nozzles and guide elements. This apparatus is extremely complicated and requires the use of a large number of matched manipulation facilities.

Other techniques have also been known for repairing a yarn supply in weaving machines in the case of an interruption between the yarn package and a weft accumulator, for example, as described in EPA 0 269 140. However, in such cases, the guiding of an unbroken yarn end from a package is not accurately controlled.

Other techniques have also been known from EPA 0128121 which describes the use employs a suction nozzle for controlling a broken yarn end from a yarn package.

It is an object of the invention to provide a simple but reliable automatic yarn threading device.

It is another object of the invention to provide for an automatic clearing of a yarn break in a weaving machine.

It is another object of the invention to provide a relatively simple system for guiding a yarn for rethreading in a weaving machine.

Briefly, the invention is employed in a loom which includes a picking nozzle and a yarn storage device for feeding a predetermined length of yarn to the picking nozzle from a yarn package. In accordance with the invention, a first yarn guiding passage extends to the storage device for guiding a yarn from the package to the storage device while a second yarn guiding passage extends between the storage device and the picking nozzle for guiding the yarn therebetween.

The invention therefore provides a closed system which extends from the package to the picking nozzle and in which a new yarn is guided and a yarn breakage is cleared. Additional manipulators associated with the package or bobbin carrier, yarn storage device and picking nozzle are unnecessary. Further, there is no need for any splicing or knotting, and so fabric quality is not impaired.

As a rule, the yarn-conveying passage between the yarn storage device and the picking nozzle will have to be flexible or an articulated connection will be necessary between the storage device and the picking nozzle. Since the picking nozzle follows reed movement at least to some extent, the yarn-guiding passage must execute at least this movement. Thus, this yarn-guiding passage may be in the form of a flexible tube or hose. However, an articulated connection of a relatively rigid yarn-guiding passage to the yarn storage device or picking nozzle is preferred. The articulated connection can be embodied, for example, by ball joints or helical springs and/or cones embodied more particularly by wire coils. The advantage of such cones is that the yarn-guiding air can escape through them and so causes no disturbance in the next part of the yarn-guiding system.

The yarn-guiding passage between a yarn package and the yarn storage device extends at one end into an entry cone in the storage device and has a cone entry at the other end embodied, for example, by wire coils or by a fixed funnel wall appropriately perforated.

Another advantage of this continuous yarn-guiding passage from the package to the picking nozzle via the yarn storage device is that the speed of yarn guidance can be relatively reduced by an appropriate control of air nozzles or threading nozzles, thus ensuring that the yarn end is not untwisted or bulked with a consequent risk of entanglement.

At least one nozzle is associated with the two yarn-guiding passages and is responsible for yarn conveyance in the particularly passage concerned. Also, a threading nozzle is disposed in the yarn storage device to convey a yarn at the start of threading, or in the event of a yarn breakage, into a yarn-guiding trough in the storage device by which the yarn is guided to the second yarn-guiding passage.

A storage or winding head adapted to receive stored turns of yarn is disposed in the yarn storage device. In addition, shears for severing stored turns of yarn are associated with the storage head and a suction nozzle is provided for extracting the yarns severed by the shears. If, for example, a yarn breakage occurs between the yarn storage device and the picking nozzle, appropriate sensors detect the breakage. The loom is stopped immediately and the residual yarn is extracted by a first pick deflection disposed after the picking nozzle. The turns of yarn on the storage head are severed by the shears and extracted by way of the corresponding extractor nozzle.

Both the air nozzles for the yarn-guiding passages and also the threading nozzle in the yarn storage head are then restricted so that a yarn end is supplied to the picking nozzle. The storage head is then rotated to the yarn by way of a stopper and winds a number of turns on the head. Thereafter, normal operation of the loom resumes.

According to another feature of the invention, means for clamping the yarn are disposed between the first yarn-guiding passage and the package. This clamping means can be opened by a pin or the like and cooperates with a threading nozzle by means of which a yarn can be blown into the first yarn guiding passage.

If, for example, a yarn breakage occurs between the clamping means and the yarn storage device, appropriate sensors detect the breakage. The clamping means therefore close and retain the yarn. Picking continues until the remainder of the yarn has been unwound from the yarn storage device and picked. Thereafter, the loom restarts and all the threading and air nozzles resume operation, the clamping means opening. The yarn is therefore introduced into the first yarn-guiding passage and goes by way of the yarn storage device to the picking nozzle, after which the yarn is retained in a first pick deflection. The yarn storage device resumes rotation to wind sufficient yarn thereon. Thereafter, operation can be resumed.

The yarn is best retained by a clamp disposed on a carrier plate, each package having its own clamp. At bobbin changing, the package carrier can be rotated to advance the next package or bobbin whose yarn is already disposed in its clamp on the carrier plate, the same also corotating. However, many variants are conceivable.

In another embodiment, instead of the threading nozzle or clamping means, an independent suction nozzle for engaging the yarn can be associated with the package. In this case, a cone of wire coils is disposed at the first yarn-guiding passage and the yarn is conveyed between the package and the cone. The conveyance is effected by the suction nozzle which is disposed for movement between the package and the cone. To transfer the yarn into the cone, an air nozzle which blows the yarn end into the cone is disposed in the mouth of the suction nozzle. During this transfer, the suction nozzle or a lever disposed thereon bears on the package and prevents excessive rolling-up or unrolling of the yarn from the package. This can be effected mechanically quite simply by providing a sleeve on the suction nozzle through which the lever extends. A corresponding spring which connects one arm of the lever to the suction nozzle maintains the lever in the pressing position.

This invention facilitates automatic threading of a waft yarn from the bobbin to the picking nozzle. The invention also provides automatic clearance of a yarn breakage anywhere without the need for disadvantageous splicing or knotting in the cloth. The whole is achieved without expensive manipulators and so in this respect the cost of servicing will probably be reduced.

These and other objects and advantages of the invention will become more apparent from the following detailed description taken in conjunction with the accompanying drawings wherein:

FIG. 1 diagrammatically illustrates a side view of an air jet loom employing an apparatus in accordance with the invention;

FIG. 11 illustrates a diagrammatic view of a modified arrangement for feeding packages to a loom;

FIG. 12 illustrates a diagrammatic view of a further modified apparatus for conveying packages to a loom; and FIG. 13 illustrates a top view of the arrangement of FIG. 12.

Figure 1:
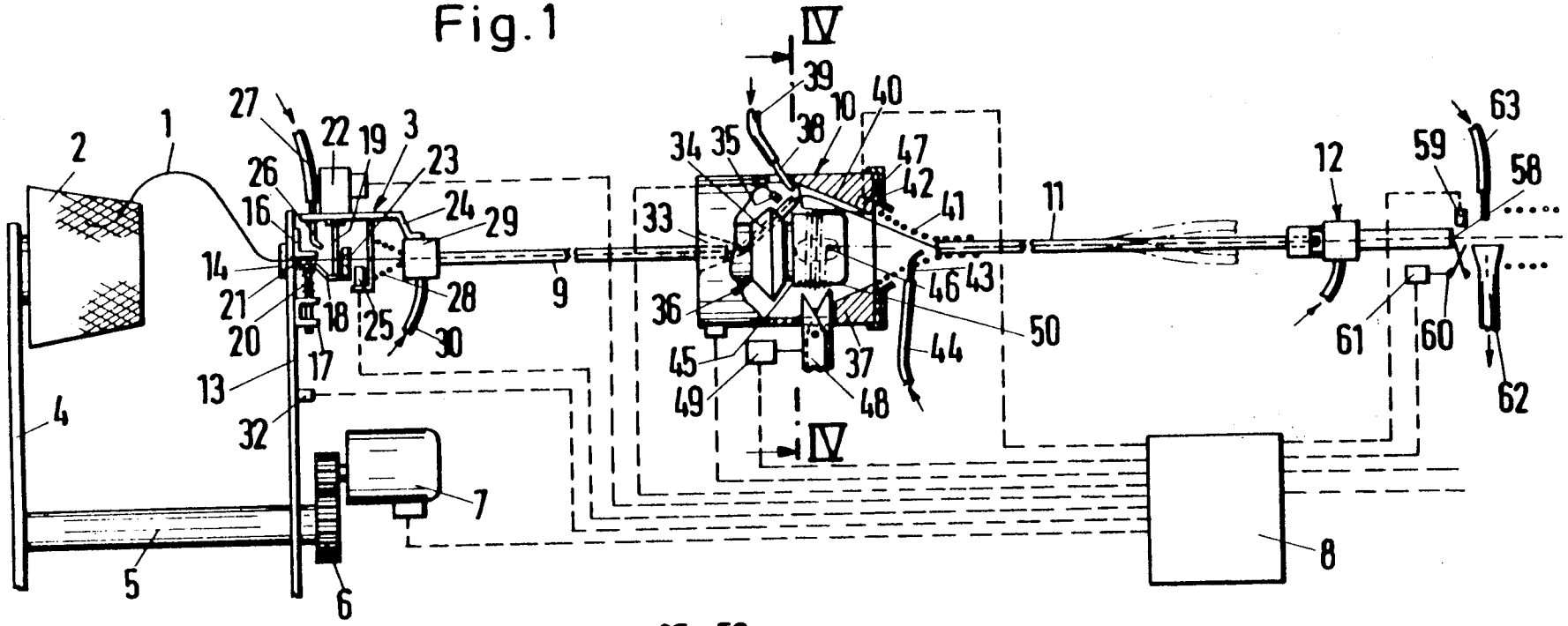

Referring to FIG. 1, the loom is constructed in the manner of an air jet loom. As indicated, the loom has a bobbin or yarn package carrier 4 for supplying a yarn 1, a yarn clamping means 3, a yarn storage device 40 and a picking nozzle 12.

As indicated, the carrier 4 is m[illegible]ed on a shaft 5 for rotation about the a[illegible] the shaf[illegible]d is connected by way of a gear 6 on [illegible]ft 5 to a drive 7 by means of which the carrier 4 i[illegible] rotated about the axis of the shaft 5. The drive 7 is, in turn, connected by a suitable line extending to a control unit 8 so as to be actuated thereby.

Figure 2:
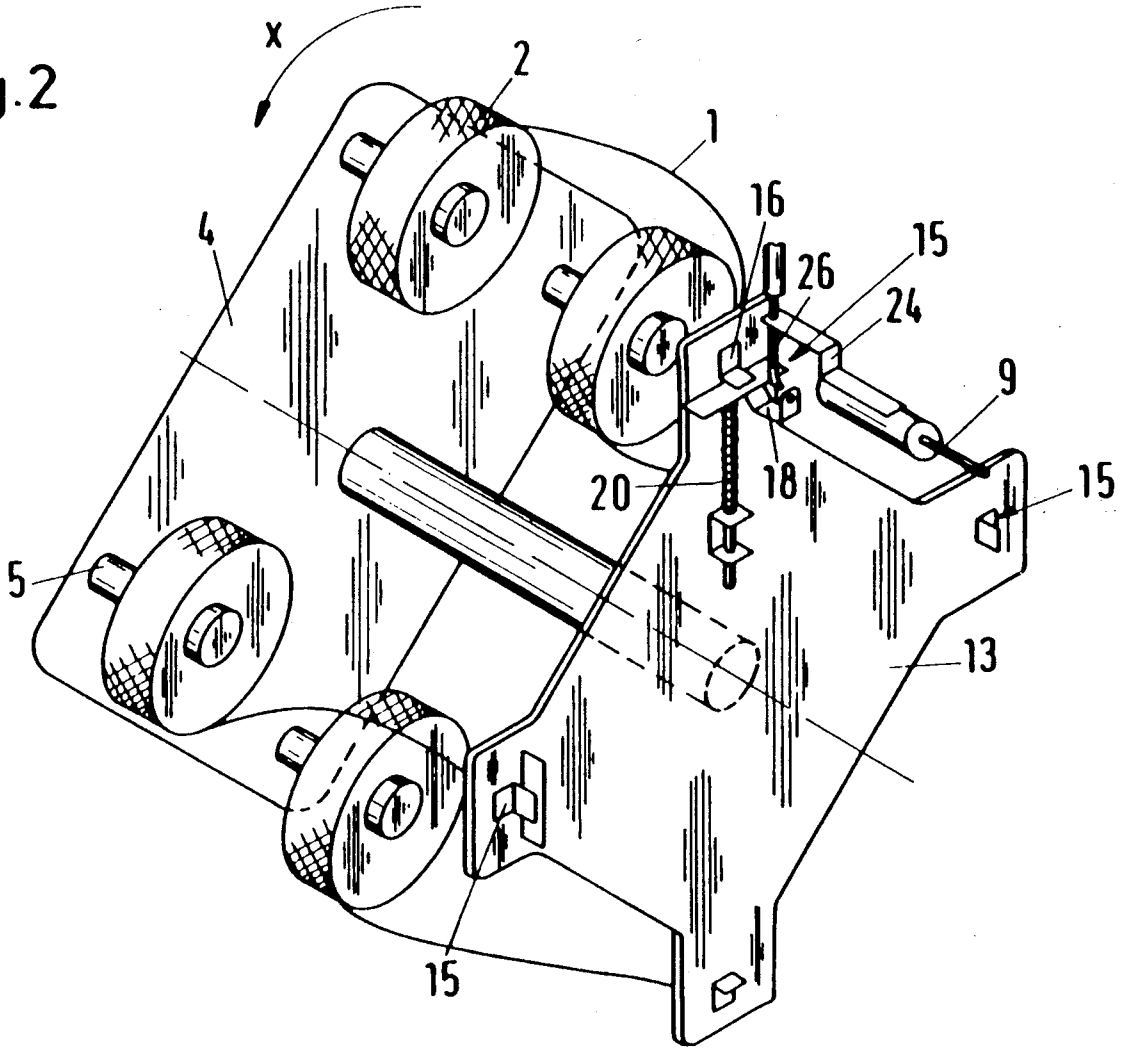
FIG. 2 illustrates a perspective view of a carrier having a plurality of packages mounted thereon in accordance with the invention.

Referring to FIG. 2 the carrier 4 is constructed to carry a plurality of packages 2, for example four packages and can be rotated via the control unit 8 and drive 7 so as to bring each package successively into an operative position relative to the clamping means 3.

Referring to FIGS. 1 and 2, a carrier plate 13 is also disposed on the shaft 5 for rotation with the carrier 4. The plate 13 has an orifice 14 in the form of a yarn eyelet (see FIG. 1) through which a yarn 1 may be passed to be held in a clamp 15 of the clamping means 3.

As indicated in FIG. 2, the clamp 15 is embodied by a plate in the form of an angle member 16 which is secured to the plate 13 and by a second plate in the form of a section member 18 which is mounted on the plate 13 opposite the angle member 16 for clamping a yarn 1 therebetween. In addition, the section member 18 is movably mounted on a channel section member 17 and biased by a helical spring 20 into engagement with the angle member 16. The section member 18 is actuated by means of an opening pin 19 so as to be selectively moved relative to the angle member 16.

In order to open the clamp 15, the bobbin carrier 4 is rotated in the direction x as indicated in FIG. 2 so as to align the clamp 15 with the pin 19. This corresponds to the operative position of the carrier 4. At this time, the pin 19 is actuated by an appropriate drive 22, for example, an air cylinder or a screw threaded spindle actuated by the control unit 8 so as to move the section member 18 downwardly, as viewed in FIG. 1. This causes the clamp 15 to open so as to form a gap 21 between the members 16, 18.

As illustrated in FIG. 1, another guide plate formed with a corresponding orifice 23 is disposed downstream of the plate 13 in alignment with the orifice 14 when in the operative position. This guide plate, as shown in FIG. 2, is connected with the section member 18 of the clamp 15 and so rotates with the plate 13.

The drive 22 for the pin 19 is mounted on an angle section 24 which is stationary relative to the clamp plates 16, 18. Thus, when the plate 13 and the bobbin carrier 4 rotate, the members 16, 18 corotate but the angle section 24 does not. As indicated in FIG. 1, a sensor 25 is mounted in depending relation from the angle section 24 in order to detect termination of a package and to deliver a corresponding signal to the control unit 8. This sensor 25 is aligned with the orifice 23 in the second guide plate in order to sense the passage of a trailing end of a yarn 1 from the package 2.

A threading nozzle 26 is connected to the angle member 24 and is supplied with air via a compressed air line 27. This nozzle 26 is directed towards the orifice 23 and, upon actuation, blows a yarn through the orifice 23.

Referring to FIG. 1, the clamping means 3 is aligned with a yarn-guiding passage 9 which extends to the yarn storage device 10. In addition, a second yarn-guiding passage 11 is connected between the yarn storage device 10 and the picking nozzle 12. As indicated, each yarn-guiding passage 9, 11 is in the form of a tube for guiding a yarn therethrough in a closed a closed path.

The first yarn-guiding passage 9 cooperates with an air nozzle 29 at an upstream end which serves to draw a yarn 1 into and through the passage 9. As indicated, an entry cone 28 is provided at the upstream end of the nozzle 29 and is in the form of a coiled wire loop. The cone 28 is aligned with the orifice 23 and the threading nozzle 26 so that upon actuation of the nozzle 26, a yarn can be blown into the cone 28. In this respect, since the cone 28 is made in the form of a wire coil, excess air can be dispersed through the cone 28 into the surrounding environment without interfering into the entry of the yarn into the nozzle 29 and, subsequently, into the passage 9. The cone 28 may also be in the form of a solid with a perforated wall or in the form of a wire mesh. As indicated, the nozzle 29 has a supply line 30 for the injection of support air which serves to draw the yarn 1 into the nozzle 29 and inject the yarn into the passage 9.

During operation, the clamping means 3 is operative to retain a yarn 1 when in a stand-by position and to release the yarn when the yarn is to be used as a weft yarn for picking into a shed. The drive 22 may be actuated electromagnetically.

Conveyance of the yarn within the guiding system should be slowed down to prevent the yarn end from unraveling as a result of rapid actuation of the clamping means 3.

As illustrated in FIG. 1, a further sensor 32 is associated with the carrier plate 13 in order to report the position of the plate 13 to the control unit 8.

Figure 3:
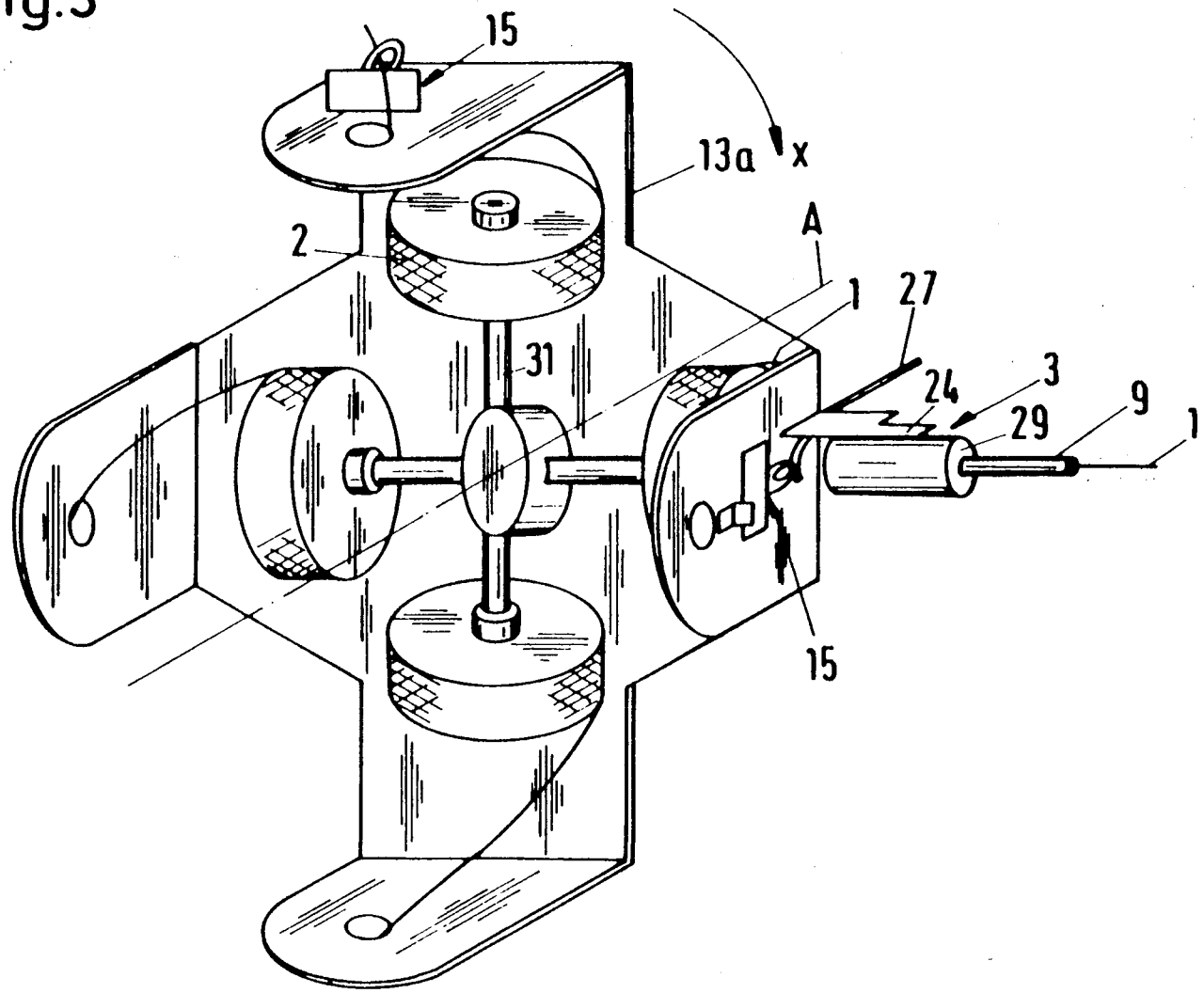
FIG. 3 illustrates a modified carrier having a plurality of yarn packages mounted thereon in accordance with the invention.

Referring to FIG. 3, the bobbin carrier may also be constructed so that the bobbins or packages 2 are disposed on rods 31 and rotate about a rotational axis A which extends radially of the guide axis of the yarn 1, and in the present case, is shown only in chain lines. Correspondingly, the carrier plate 13A rotates in a direction corresponding to the direction of guidance of the yarn 1. In other respects, the construction of the clamp 15 and of the complete clamping means corresponds to the embodiment of FIG. 2.

Referring to FIG. 1, the yarn guiding passage 9 extends into the yarn storage device 10 whose construction is basically known. The yarn passes from a conically shaped entry in the device 10 into a rising guide passage 34 with which a sensor 35 for detecting the position of the passage 34 is associated. During weaving, the entire unit 36 in which the passage 34 is located rotates in a casing 37 of the storage device 10. However, when a weft yarn is being threaded, the exit of the passage 34 is disposed before an air nozzle 38 which has a compressed air connection 39. The yarn is guided by the nozzle 38 along a casing inner wall 40 to a cone 41 connected by way of a corresponding cup seal 42 to the casing 37. The cone 41 of the present embodiment is embodied by coiled wire loops. Another threading nozzle 43 having a connection to a pressure line 44 extends into the cone 41. This nozzle 43 guides the yarn 1 through the yarn-guiding passage 11, air from the nozzle 38 escaping through the wire loops of the cone 41.

In weaving, the yarn 1, shown in chain-dotted lines is wound on a storage head 45 of the storage device 10 and laid over a known kind of stopper 45. A further sensor 47 counts the turns.

Figure 4:
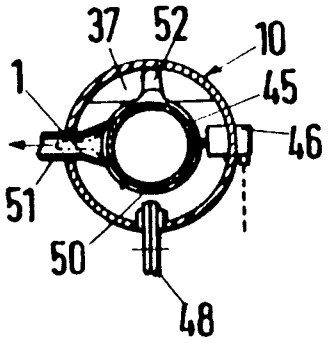
FIG. 4 illustrates a view taken on line IV—IV of FIG. 1.

Should a yarn break, a yarn residue normally remains on the head 45. In this case, shears 48 are actuated by way of a corresponding drive 49 under the control of the unit 8. Either the shears 48 engage in a recess 50 in the head 45, the latter recess being bridged by the yarn 1, and sever the turns of yarn in the recess 50 or the storage head 45 itself is in the form, for example, of wire elements which are disposed with their axes parallel to one another and between which the shears 48 can engage. The residual severed yarn 1 is removed by an extractor nozzle 51 as shown in FIG. 4. During threading, the yarn 1 is guided in a thread-guiding trough 52 shown in FIGS. 4.

Figure 5:
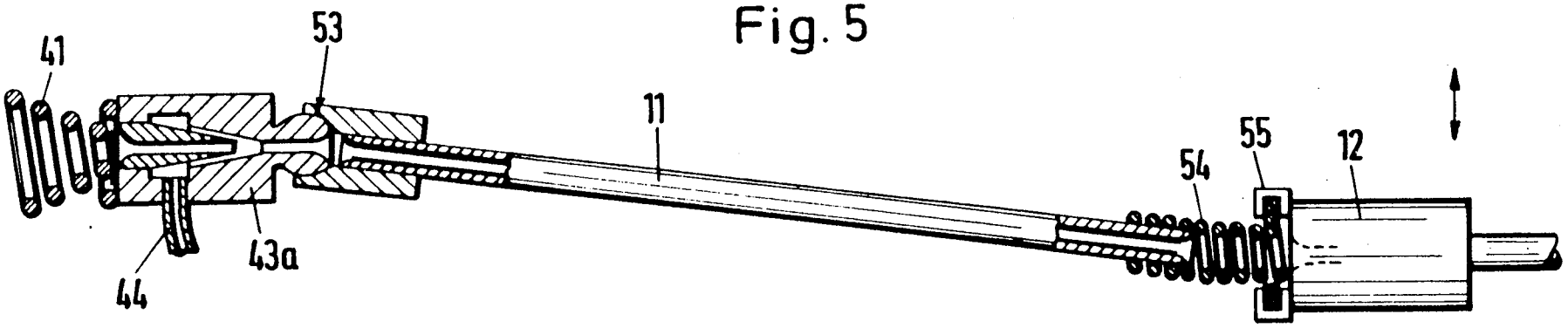
FIG. 5 illustrates a side view of an articulated connection between a yarn guiding passage, a yarn storage device and a picking nozzle in accordance with the invention

The cone 41 communicates with the second yarn-guiding passage 11 which extends into the picking nozzle 12. Since the nozzle 12 must reciprocate together with the reed (not shown) whereas the cone 41 is stationary, the passage 11 is articulated via a flexible connection to the nozzle 12 and yarn storage device 10. One such flexible connection is shown by way of example in FIGS. 5, where the cone 41 extends into the threading nozzle 43*a*. The connection with the yarn-guiding passage 11 is, in this case, by way of a ball joint 53, the other end of the passage 11 being received in a helical spring 5 connected to the picking nozzle 12. To this end, a cup seal 55 is provided which engages over the ends of the turns of the spring 54. However, it would be possible to use a ball joint for the connection between the second yarn-guiding passage 11 and the picking nozzle 12.

Figure 6:
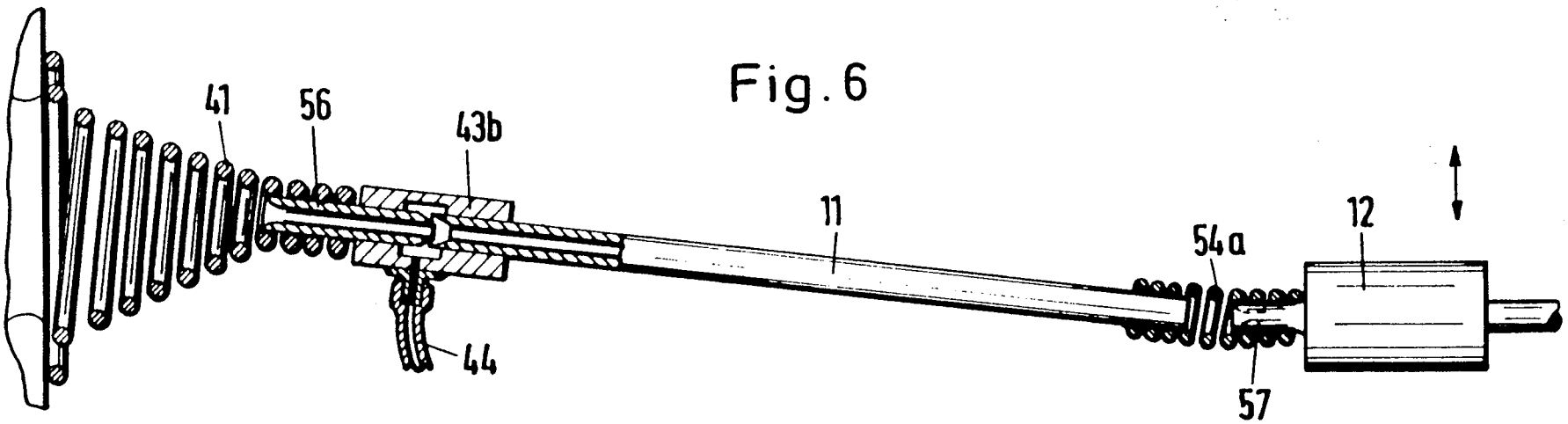
FIG. 6 illustrates a view similar to FIG. 5 of a modified articulated linkage for a yarn guiding passage in accordance with the invention.

Referring to FIG. 6, the threading nozzle 43*b* is disposed by way of a support 56 in the cone 41 so as to be able to move when the passage 11 moves. At the other end, the passage 11 is introduced into the helical spring 54*a* which, in this case, engages over a connection nipple of the picking nozzle 12. However, these are merely embodiments and are not intended to set a limit to the normal skill of a skilled addressee. However, the presence of the helical spring 54 between the passage 11 and the nozzle 12 ensures that the air guiding the yarn in the passage 11 can escape before entering the picking nozzle 12.

Referring to FIG. 1, a sensor 59 which provides a check on threading is associated with the exit orifice of the picking nozzle 12. Also, disposed in the same zone are further shears 60 and an associated actuating mechanism 61 Also provided is a suction nozzle 26 which cooperates with an air nozzle 63 and which is operative for first weft deflection and/or weft breakage clearance.

The first automatic weft-threading system operates as follows.

To thread a new yarn, the loom itself is stopped. Any residual yarn present is then extracted by the extractor nozzle 62. The yarn winder or storage head 45 in the yarn storage device 10 is moved into registration with the yarn-guiding trough 52 (FIG. 4), the guiding passage 34 being disposed near the air nozzle 38. The drive 7 now rotates the bobbin carrier 4 and moves a full package into the feed or supply position. By way of the drive 22 and pin 19, the clamp 15 is opened by pushing down, as viewed in FIG. 1, the member 18 and the threading nozzles 26, 38, 43 being simultaneously activated. Also, the air nozzle 29 is supplied with compressed air. The yarn 1 is therefore conveyed to the picking nozzle 12 until the sensor 59 detects the presence of the yarn. The corresponding nozzles 26, 29, 38, 43 are now rendered inoperative. The yarn can be briefly retained by the suction nozzle 62 in this operative position.

The storage head stopper 45 then engages the yarn 1 and winds a supply of yarn onto the head 45. The sensor 35 can control the number of turns and the sensor 47 counts them.

The yarn tip is then severed by the shears 60 and extracted by the nozzle 62. The loom then starts.

Any weft breakage between the storage device 10 and the picking nozzle 12 is detected by the sensor 59 which delivers a signal to the unit 8 to stop the loom. The shears 48 in the storage device 10 are then actuated and sever the turns of yarn present on the head 45. The extractor nozzle 51 (FIG. 4) extracts the severed yarn residues and the extractor nozzle 62 removes any remaining yarn in the passage 11 or picking nozzle 12. However, the yarn remains intact until issuing from the passage 34 in the storage device 10. The corresponding threading nozzles or air nozzles can then be actuated to resume conveyance of the yarn to the picking nozzle 12 where the sensor 59 detects the presence of yarn again. Operations then proceed as hereinbefore described.

In the event of a yarn breaking between the package 2 and the storage device 10, the loom stops after the supply of yarn in the storage device 10 has been exhausted, the turns-counting sensor 47 outputting an error signal. However, should the sensor 25 detect yarn presence, actuating the corresponding threading nozzle suffices for conveyance of the yarn to be resumed as far as the threading check sensor 59.

An automatic searching for the yarn of a package 2 and for transferring this yarn 1 to the clamping means 1 may also be performed. According to FIGS. 7 and 8, therefore, the bobbin or package 2 is adapted to rotate around a pivot 64. In addition, a friction wheel 65 is mounted on the pivot 64 and has an end face in rolling engagement with a drive wheel 66 as shown in FIG. 8. In a manner not further shown, the wheel 66 is connected to an appropriate drive. Also, a mouth 67 of a suction nozzle 68 is associated with the package 2. The nozzle 68 can be moved along and away from the package surface, as indicated by double arrows, through the agency of an appropriate linkage 69. A hose 70 provides a connection to corresponding suction means.

To search for the yarn, the package 2 is rotated. The nozzle 68, i.e., the nozzle mouth 67, moves over the package surface searching for the yarn 1. When the yarn has been found and enters the mouth 67, its presence is detected, for example, by a photocell (not shown). The drive of the bobbin or package 2 is then stopped. The yarn itself is retained in the mouth 67 by the negative pressure and the suction nozzle 68 moves from the chain-line position shown in FIG. 8 to the right into an operative position in which the mouth 67 is disposed near a cone 71 which is part of the complete system for conveying yarn to the picking nozzle 12. The cone 71 is followed by a tubular member 72 which terminates, for example, in the orifice 14 (see FIG. 1).

To transfer the yarn 1 from the nozzle 68, an air nozzle 73 is associated therewith near the mouth 67 and blows the yarn 1 into the cone 71. This cone 71 is embodied by corresponding wire loops so that the injected air can escape therefrom.

Also, a sleeve 74 is secured to the nozzle 68 and a multi-set lever 75 extends through the sleeve 74. A spring 76 (see FIG. 7) secured to the nozzle 68 retains one end of the lever 75. Consequently, in the operative position shown in FIG. 8, one arm 77 of the lever 75 is pressed onto the package 2. The arm 77 prevents uncontrolled draw-off of yarn 1 from the package 2 and ensures a supervised supply of yarn 2 to the cone 71. Of course, the arm 77, i.e. the lever 75, can be disposed separate from the nozzle 68 and fulfill its purpose correspondingly.

Figure 7:
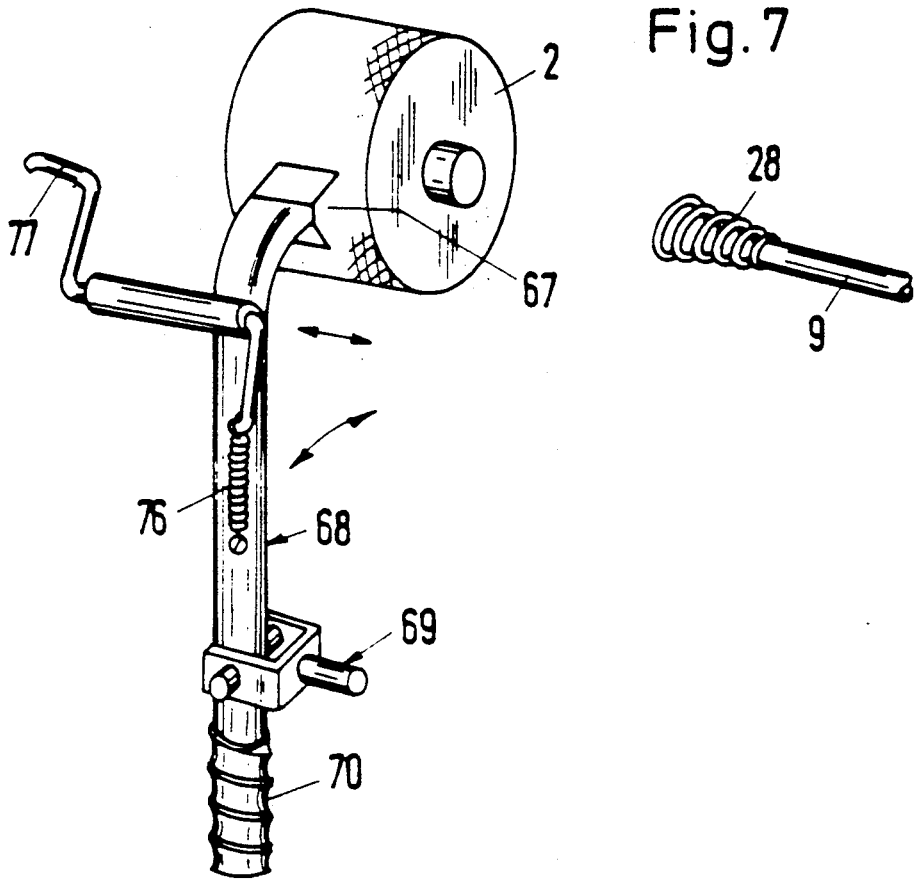
FIG. 7 illustrates a perspective view of a suction nozzle for transferring a yarn end from a package to the first yarn guiding passage in accordance with the invention.
Figure 8:
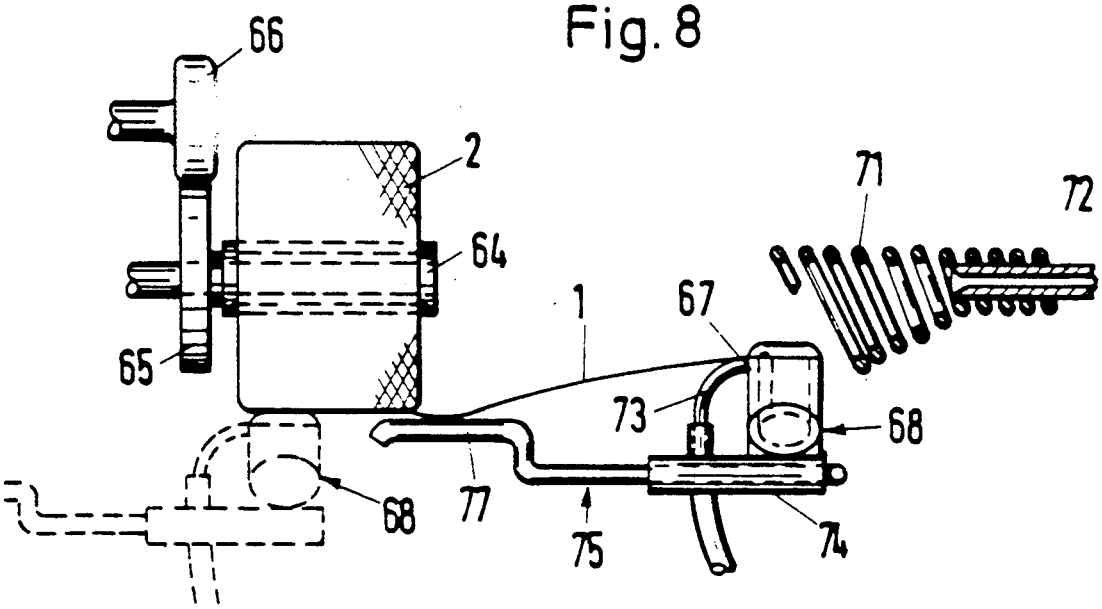
FIG. 8 illustrates a plan view of the arrangement of FIG. 7.

In the embodiments shown in FIGS. 7 and 8, clamping means 3 such as are shown in FIG. 1 can be omitted. In this event, however, the nozzle 68 would have to search for the yarn of each new package moved into the operative position. This embodiment is intended to be represented by the indication of the cone 28 and yarn-guiding passage 9 in FIG. 7.

Figure 9:
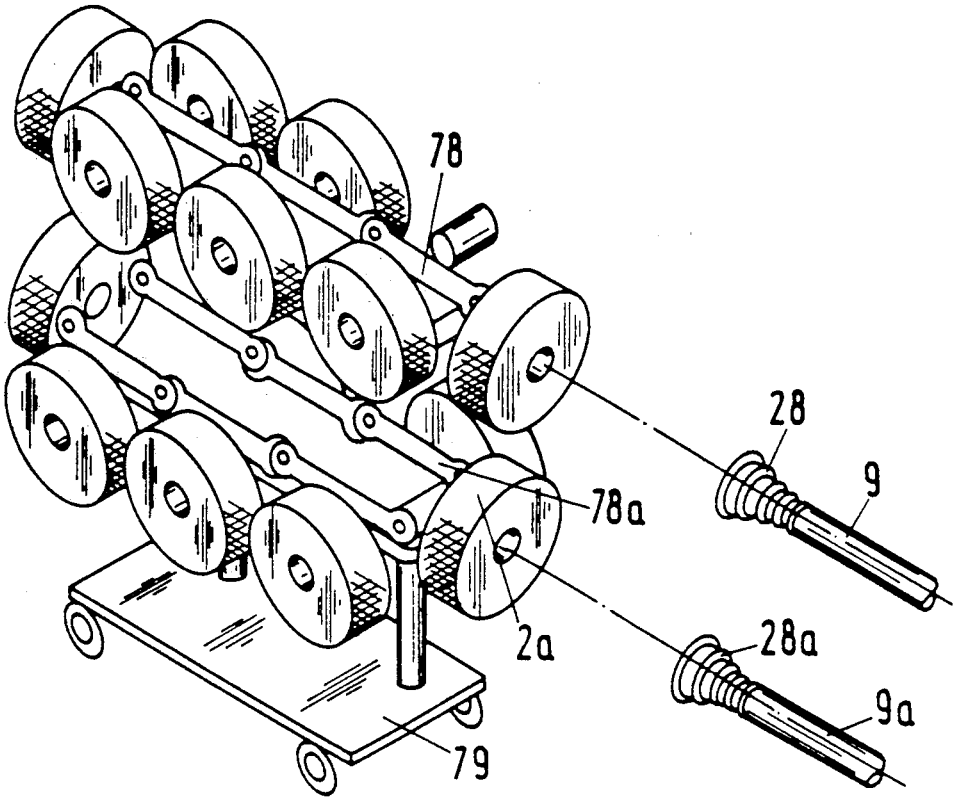
FIG. 9 illustrates a perspective view of a modified package carrier for a plurality of packages in accordance with the invention.

Packages to be used for an air jet loom can be presented in a variety of ways. FIG. 9 shows an example wherein the bobbins or packages 2 are disposed on a chain 78. Two chains 78 are disposed one above another on a trolley 79. When a package 2 is empty, a drive (not shown) moves the chain 78 and the next package is fed to the cone 28 and the subsequent yarn-guiding passage 9. In this case, a yarn-transferring facility such as is shown in FIGS. 7 and 8 is used. The embodiment of FIG. 9 is also of use to enable two yarns to be woven simultaneously. To this end, a second chain 78*a* with packages 2*a* is disposed below the first chain 78, the corresponding yarn being drawn off by the cone 28*a* and a yarn-guiding passage 9*a*. More than two yarns can of course be dealt with in this way.

Figure 10:
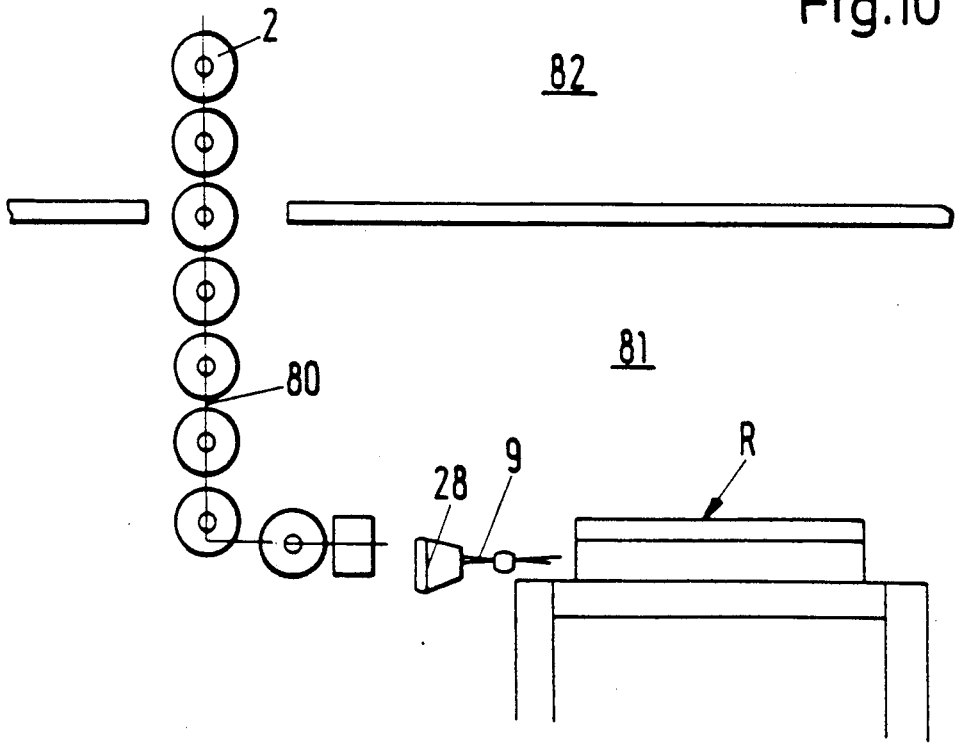
FIG. 10 illustrates a diagrammatic view of a conveying system for feeding packages to a loom.

The packages 2 can also be conveyed as shown in FIG. 10. In this case, the packages 2 are disposed on a conveyor belt 70 and are fed to the cone 28 of a loom R. The conveyor belt 80 can extend from a weaving space 81 to a storage space 82 where the belt 80 is supplied with packages 2.

If the packages 2 are all of substantially the same dimensions, they can be stored or supplied as shown in FIGS. 11-13. In FIG. 11, the bobbins 2 are stored vertically in a shaft or gallery or magazine or the like 83. By means of radially movable thrust pads 84, one package at a time can drop onto the corresponding bobbin carrier 4*a* in the manner shown more particularly in FIG. 3. The yarn is then drawn off by means of the kind shown in FIGS. 7 and 8, the yarn 8 being received by the cone 28.

Referring to FIGS. 12 and 13, the packages 2 are disposed on a conveyor belt 85 with the foremost package 2 abutting stoppers 86. Here a package 2*a* is transferred to a rotating cross 87 which engages by way of a hooked arm 88 in a corresponding axial aperture 89 in the package 2. The cross 87 rotates around a pivot 90 and thus presents the packages 2 seriatim to the cone 28 and subsequent yarn-guiding passage 9.

The invention thus provides a closed system for the conveyance of a yarn for threading into a loom. In this respect, the invention provides a system wherein splicing and/or knotting of yarns can be avoided when replenishing weft yarn to a loom.

The invention also provides a system which can be automatically searched for a broken weft yarn and which can be, automatically re-threaded.

What is claimed is:

1. In a loom, the combination comprising
a picking nozzle;
a yarn storage device for feeding a predetermined length of yarn to said picking nozzle;
a first yarn guiding passage extending to said storage device for guiding a yarn from a package in a closed path to said storage device; and
a second yarn guiding passage extending to and between said storage device and said picking nozzle for guiding a yarn therebetween in a closed path.

2. The combination as set forth in claim 1 which further comprises an articulated connection for connecting said second guiding passage to at least one of said storage device and said picking nozzle to follow movements of said picking nozzle.

3. The combination as set forth in claim 1 which further comprises a ball joint articulating said second guiding passage to at least one of said storage device and said picking nozzle.

4. The combination as set forth in claim 1 which further comprises a helical spring articulating said second guiding passage to at least one of said storage device and said picking nozzle.

5. The combination as set forth in claim 1 which further comprises a conical spring articulating said second guiding passage to at least one of said storage device and said picking nozzle.

6. The combination as set forth in claim 1 wherein said storage device has a conical entry at an upstream end to receive said first yarn guiding passage therein and which further comprises an entry cone at an upstream end of said first yarn guiding passage for guiding of a yarn therein.

7. The combination as set forth in claim 6 which further comprises a first threading nozzle at an upstream end of said first guiding passage to thread a yarn thereinto and a second threading nozzle at an upstream end of said second guiding passage to thread a yarn thereinto.

8. The combination as set forth in claim 1 which further comprises a threading nozzle in said storage device for conveying a yarn into a yarn guiding trough thereof.

9. The combination as set forth in claim 8 wherein said storage device includes a head to receive a plurality of yarn windings, a shears for severing stored yarn windings on said head and an extraction nozzle for extracting several yarns from said head.

10. The combination as set forth in claim 1 which further comprises a suction nozzle adjacent to a downstream end of said picking nozzle.

11. The combination as set forth in claim 1 which further comprises means for clamping a yarn from the package upstream of said first yarn guiding passage.

12. The combination as set forth in claim 11 wherein said means for clamping includes a first plate, a second plate opposite and biased toward said first plate for clamping a yarn therebetween and a selectively movable pin for moving said second plate from said first plate.

13. The combination as set forth in claim 12 which further comprises a rotatably mounted carrier plate for holding at least one yarn package thereon, said carrier plate having said plates of said clamping means positioned thereon for rotation into alignment with said pin.

14. The combination as set forth in claim 11 which further comprises a threading nozzle disposed in said means for clamping to on unclamped yarn into said first guiding passage.

15. The combination as set forth in claim 1 which further comprises a carrier plate for at least one yarn package upstream of said first guiding passage and a suction nozzle for engaging a yarn of the package.

16. The combination as set forth in claim 15 which further comprises means defining a conically shaped inlet into said first guiding passage, and means for moving said suction nozzle between said carrier plate and said means.

17. The combination as set forth in claim 16 which further comprises an air nozzle on said suction nozzle for blowing a yarn drawn into said suction nozzle from a package on said carrier plate into said means on said first guiding passage.

18. The combination as set forth in claim 17 which further comprises a pivotally mounted lever on said suction nozzle for engaging a yarn package on said carrier plate during movement of said suction nozzle to said means on said first guiding passage.

19. The combination as set forth in claim 18 which further comprises a sleeve on said suction nozzle rotatably receiving said lever therein and a spring connected between said suction nozzle and said lever to bias said lever against a package.

20. The combination as set forth in claim 1 which further comprises means for clamping a yarn from the package upstream of said first yarn guiding passage and wherein said second guiding passage is articulated to at least one of said storage device and said picking nozzle to follow movements of said picking nozzle.

21. In a loom, the combination comprising
a carrier for at least one yarn package;
a yarn storage device for accumulating a predetermined length of yarn for a pick;
a yarn guiding passage extending to said storage device for guiding a yarn from the package on said carrier to said storage device;
a yarn clamp for clamping a yarn from said package upstream of said passage;
an entry cone at an upstream end of said passage for guiding a yarn therein; and
a threading nozzle for blowing a yarn released from said clamp into said entry cone for delivery to said passage.

22. The combination as set forth in claim 21 wherein said clamp includes a stationary first plate, a movable second plate opposite said first plate for clamping a yarn therebetween and means for selectively moving said second plate relative to said first plate.

23. The combination as set forth in claim 22 wherein said plates of said clamp are mounted on said carrier and said carrier is rotatable about an axis thereof.

24. In a loom, the combination comprising a picking nozzle;

a yarn storage device for feeding a predetermined length of yarn to said picking nozzle;

a first yarn guiding passage extending to said storage device for guiding a yarn from a package to said storage device;

a second yarn guiding passage extending between said storage device and said picking nozzle for guiding a yarn therebetween;

a first threading nozzle at an upstream end of said first guiding passage to thread a yarn thereinto;

a second threading nozzle at an upstream end of said second guiding passage to thread a yarn thereinto;

a third threading nozzle in said storage device for conveying a yarn into a yarn guiding trough thereof;

an air nozzle at an upstream end of said first passage for blowing a yarn therethrough; and a control unit for selectively actuating said nozzles for threading of a yarn through said passages, said storage device and said picking nozzle.

25. The combination as set forth in claim 24 wherein said storage device includes a head to receive a plurality of yarn windings, a shears for severing stored yarn windings on said head and an extraction nozzle for extracting several yarns from said head.

26. The combination as set forth in claim 24 which further comprises a suction nozzle at a downstream end of said picking nozzle.

27. The combination as set forth in claim 24 which further comprises means for clamping a yarn from the package upstream of said first yarn guiding passage.

* * * * *

UNITED STATES PATENT AND TRADEMARK OFFICE

CERTIFICATE OF CORRECTION

PATENT NO. : 5,012,844

DATED : May 7, 1991

INVENTOR(S) : JOHN D. GRIFFITH

It is certified that error appears in the above-identified patent and that said Letters Patent is hereby corrected as shown below:

Column 1, line 31 after "No." insert -4,658,866-
Column 1, line 54 change "employs" to -of-
Column 2, line 45 change "particularly" to -particular-
Column 4, lines 33 to 37 change "As indicated ... in turn," to
-As indicated, the carrier is mounted on a shaft 5 for rotation about the axis of the shaft 5 and is connected by way of a gear 6 on the shaft 5 to a drive 7 by means of which the carrier 4 may be rotated about the axis of the shaft 5. The drive 7 is, in turn,-
Column 5, line 31 cancel "a closed" (second occurrence)
Column 6, line 39 change "Figs." to -Fig.-
Column 6, line 47 change "Figs." to -Fig.-
Column 10, line 20 change "on" to -thread an-

Signed and Sealed this

Eighth Day of December, 1992

*Attest:*

*Attesting Officer*

DOUGLAS B. COMER

*Acting Commissioner of Patents and Trademarks*